United States Patent [19]

Farmer

[11] 4,053,012

[45] Oct. 11, 1977

[54] BATTERY STRAP MOLD AND ANTI-DRIP POURING MEANS

[76] Inventor: John Edgar Farmer, 12034 S. Emerald Ave., Chicago, Ill. 60628

[21] Appl. No.: 607,288

[22] Filed: Aug. 25, 1975

[51] Int. Cl.[2] ..... B22D 35/04

[52] U.S. Cl. ..... 164/254; 141/119; 164/259; 164/337; 222/571

[58] Field of Search ..... 164/254, 335, 337; 222/571, 108; 141/119; 239/119

[56] References Cited

U.S. PATENT DOCUMENTS

| | | | |
|---|---|---|---|
| 3,014,620 | 12/1961 | Moore | 141/119 X |
| 3,565,162 | 2/1971 | Farmer | 164/337 |
| 3,895,748 | 7/1975 | Klingenberg | 222/571 |

*Primary Examiner*—Robert D. Baldwin

[57] ABSTRACT

An apparatus and method for gravity molding articles such as battery straps or the like in open or non-pressurized molds. The apparatus uses an upwardly inclined molding head including a molten metal reservoir and a nozzle discharge end positioned adjacent the mold for delivering molten metal into the mold. Delivery of molten metal can be from a molten lead vat through a siphon conduit and stop-cock valve at the mold head. At the end of each pour, upon closing of the stop-cock valve, a small amount of molten metal is withdrawn from the heated reservoir into a suction system to decrease the level of the reservoir slightly below the lower lip of the nozzle end and thereby prevent dripping from the nozzle end between pours. At the beginning of each pour, the molten metal is released from the suction system back into the reservoir for use in the pour.

7 Claims, 2 Drawing Figures

BATTERY STRAP MOLD AND ANTI-DRIP POURING MEANS

BACKGROUND OF THE INVENTION

1. Field of the Invention

This invention relates to apparatus for molding articles using molten metal and more particularly it relates to a system for preventing dripping between pours from the apparatus.

2. Brief Description of the Prior Art

It is known to mold battery straps and other articles using an upwardly inclined valved delivery head. For example, see my U.S. Pat. No. 3,565,162. It is also known to deliver molten metal to a molding head by gravity flow through a siphon system. See, for example, my U.S. Pat. No. 3,815,623. In mass production such systems use intermittent seriatim timed pours which are controlled in ways well known in the art. Between pours either the mold head is moved to another mold cavity or the mold cavity is removed and replaced by another such cavity so that the molding operation can continue while an article is being removed from the previous mold cavity. There has been a problem with drippage of molten metal from the nozzle end. The problem is magnified in systems in which the head is moved from cavity to cavity because the motion of the head causes sloshing of the molten metal from the nozzle. Drippage is not only wasteful, but it can be harmful not only to a previous casting on which the molten metal may fall, but also to personnel in the immediate area.

SUMMARY OF THE INVENTION

I have now found that drippage from the nozzle end of a molding head in a molten metal molding operation can be minimized or eliminated by withdrawing molten metal from the reservoir in the head at the end of each molding pour so that the molten metal level within the head is decreased below the level of the nozzle.

While this invention is susceptible of embodiment in many different forms, there is shown in the drawings and will be described in detail a specific embodiment thereof, with the understanding that the present disclosure is to be considered as an exemplification of the principles of the invention and is not intended to limit the invention to the embodiment illustrated.

DESCRIPTION OF THE PREFERRED EMBODIMENT

Figures 1, 2:
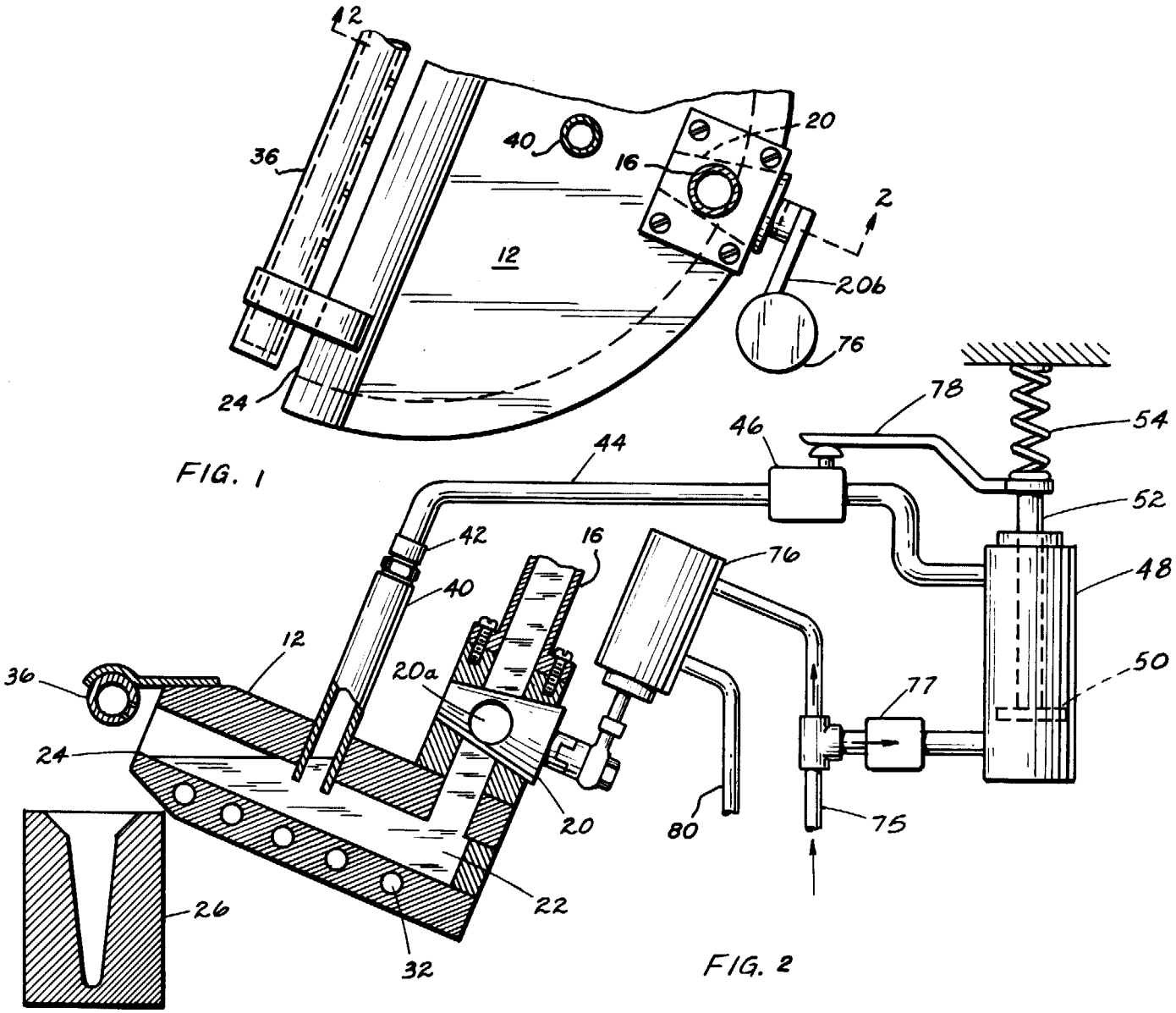
FIG. 1 is a top plan view of a molding head useful in accordance with the present invention.
FIG. 2 is a fragmentary view and section illustrating the molding head taken along line 202 of FIG. 1 and including a schematic diagram of accessory equipment.

With reference to FIGS. 1 and 2, the preferred embodiment of the invention known to the inventor at this time includes a molding head 12 which is supplied with molten lead from a molten lead vat (not shown) through a heated conduit 16. Heated conduit 16 can be in the form of a siphon having a siphon breaking fill plug such as described in my U.S. Pat. No. 3,815,623.

The heated conduit 16 feeds the molten metal by gravity flow through a valve at 20 into a molten metal reservoir 22 (see FIG. 2). The molding head 12 is disposed at an upwardly inclined angle and the lead flowing through the reservoir 22 leaves the nozzle end 24 of head 12 and flows into a mold cavity 26.

With special reference to FIG. 1, it will be noted that the reservoir 22 is of a fanned-out shape and functions as a distributor or manifold for delivering molten metal in generally equal amounts along the elongated slot-like nozzle end or opening 24 so that the entire length of a battery strap or the like can be poured generally evenly and at the same time.

In a molding operation for making an assembly of battery plates, a stack of battery plates would usually be positioned with lugs within the mold cavity 26. Thereafter, the molten metal is "cast-on" from nozzle end 24 about the lugs within the cavity. In actual practice, the lugs on the separate battery plates of the assembly are staggered right to left down the stack of plates, each plate having one lug. Thus, only every other plate is electrically connected to the same battery strap by its lug. Upon molding one battery strap connecting every other plate, the plates are reversed so that the lugs on the other alternate plates are placed within the mold cavity 26 and another battery strap is molded in the same manner as the first. The result is a pair of battery straps which electrically connect alternate plates to each other and no one battery plate to both straps.

Returning now to the molten metal supply system for reservoir 22, the valve 20 is a stopcock type of valve having a port 20*a* and an operating handle 20*b* for turning the stopcock. The stopcock is mounted in the valve housing in the normal manner, e.g. with an inconel metal spring washer or the like such as is described in my U.S. Pat. No. 3,565,162.

Reservoir 22 is heated by heating means such as electrodes 32 to maintain the metal therein in molten condition. The electrodes 32 are connected to a suitable source of electricity (not shown). Also provided in the system illustrated is an inert gas purge tube 36 near the mouth of nozzle end 24 and adjacent mold cavity 26 for minimizing oxidation of the casting in cavity 26 during molding.

Returning now to molding head 12 and with special reference to FIG. 2, a suction tap or tube 40 is mounted through the upper wall of the head 12 to extend into reservoir 22 below the level of molten lead therein, i.e. below the level of the lower lip of the open nozzle end 24. A fitting 42 connects suction tube 40 to a suction line 44 which is provided with a one-way or check valve vent 46 for venting the suction line to atmosphere to alleviate any build up in pressure due to heating of air or other fluid within line 44.

Line 44 is connected to an air cylinder 48 adjacent the upper end of the cylinder. Cylinder 48 is provided with a plunger or piston 50 secured to a stem 52 which slideably protrudes through a bore in the upper end of cylinder 48 and is biased by coil spring 54 downwardly toward the bottom of cylinder 48. Spring 54 is anchored against a suitable stationary frame or the like.

In operation of the device, with special reference to FIG. 2, pressure is supplied through line 75 on an intermittent basis with each surge of pressure being timed to complete one pour. The pressure in line 75 is applied simultaneously to spring loaded air cylinder 76 and through flow valve 77 to air cylinder 48 beneath piston 50 therein. The air pressure drives piston 50 upward to create pressure in line 44 and in tube 40 to eject molten lead from tube 40 for use as part of a pour. At the same time, pressure in air cylinder 76 drives arm 20*b* to open valve 20 so that molten lead is delivered by gravity flow from conduit 16 through port 20*a* into reservoir 22 and thence from nozzle end 24 to provide a complete pour into mold cavity 26. Once the timed pour is completed, pressure is released from line 75 and thence from air cylinder 76 and from beneath piston 50. Valve 20 is closed by the return of air cylinder 76 and piston 50 is returned downwardly by return spring 54. As piston 50 returns downwardly, an arm 78 secured to piston stem 52 opens check valve 46 to vent any build up in pressure in line 44 due to heating of air or other fluid in line 44. Depression of piston 50 also draws air through line 44 to create a suction within suction tube 40. In this condition, suction tube 40 sucks molten lead from reservoir 22 and decreases the level of molten lead in reservoir 22 beneath the level of the lower lip of nozzle end 24, thereby preventing drippage from nozzle end 24.

It is apparent from the foregoing that I have provided a new and useful molding apparatus and method which finds particular utility in the molding of elongated articles such as battery straps and the like.

I claim:

1. An apparatus for delivering molten metal to a mold cavity which comprises a molten metal delivery head including an upwardly inclined molten metal reservoir terminating in a nozzle mouth with a lower lip for pouring molten metal from the reservoir into the mold cavity, means for supplying molten metal to said reservoir, valve means movable between open and closed positions for controlling delivery of molten metal into said reservoir and through said nozzle providing intermittent delivery from the nozzle for intermittent pours into the mold cavity and suction means including a fluid tap extending below the nozzle lower lip and into direct fluid communication with said reservoir and containing a fluid for direct surface contact with molten metal in the reservoir for withdrawing molten metal from the reservoir by said suction means communicating with said tap to apply suction upon said fluid in said tap at the end of each pour so as to prevent dripping of molten metal from the end of the nozzle between pours.

2. The apparatus of claim 1 including means controlling the closing of said valve means at the end of each pour and simultaneously actuating said withdrawing means.

3. The apparatus of claim 1 wherein said nozzle end is a wide slot and said reservoir comprises means for distributing molten metal along the width of said slot.

4. The apparatus of claim 1 including means for eliminating the effect of the air expansion upon the surface level of the molten lead within said suction tap.

5. The apparatus of claim 1 including a gas purge tube at the nozzle mouth.

6. The apparatus of claim 1 wherein said valve is a rotatable stopcock.

7. An apparatus for molding battery straps or the like as in an operation for joining a plurality of spaced battery plates by the cast-on method, said apparatus comprising means defining a mold cavity, means defining a molten metal delivery head for delivering molten metal to said cavity, said head including a reservoir portion for holding molten metal and terminating in a slot-like nozzle end through which molten metal is delivered from the reservoir to the cavity, said reservoir distributing molten metal generally evenly along said nozzle slot, valve means for supplying molten metal to the reservoir operable between on and off positions for delivering intermittent pours of preselected amounts to said mold cavity for molding a plurality of individual straps or the like seriatim in said cavity, said head being mounted at an upward angle so that molten metal flows at the upward angle through the reservoir and from said nozzle slot into said cavity, a suction tap in the top wall of said reservoir for communicating with the molten metal in the reservoir below the level of the nozzle end, suction means for drawing molten metal from said reservoir into said tap, means for intermittently operating said valve to introduce the desired amount of molten metal for each pour, and close the valve to terminate the pour once the desired amount of molten metal is delivered, means responsive to said operating means and operating concurrently therewith for actuating said suction means to draw metal into said suction tap upon closing of said valve and to release molten metal from said suction tap upon opening said valve at the beginning of each pour, and means for eliminating the effect of the air expansion upon the surface level of the molten lead within said suction tap.

* * * * *